US006499913B2

(12) United States Patent
Garofalo

(10) Patent No.: US 6,499,913 B2
(45) Date of Patent: Dec. 31, 2002

(54) HYDROSTATIC BALANCING JACKET WITH REMOVABLE BALLAST

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/784,129

(22) Filed: Feb. 16, 2001

(65) Prior Publication Data

US 2001/0016149 A1 Aug. 23, 2001

(30) Foreign Application Priority Data

Feb. 18, 2000 (IT) ..... GE00A0021

(51) Int. Cl.[7] ..... B63C 11/30
(52) U.S. Cl. ..... 405/186; 405/185
(58) Field of Search ..... 405/185, 186; 224/271; 190/110; 2/94, 249–251; 24/702, 658

(56) References Cited

U.S. PATENT DOCUMENTS 4,887,932 A 12/1989 Toth
5,085,163 A * 2/1992 VanTassel et al. ..... 405/186
5,199,820 A * 4/1993 Nicklo ..... 405/186
5,205,672 A 4/1993 Stinton
5,494,377 A 2/1996 Garofalo
5,641,247 A 6/1997 Seligman
5,664,716 A * 9/1997 Nuckolls ..... 190/110 X
5,913,640 A 6/1999 Bortner
6,145,171 A * 11/2000 Hoshino ..... 24/658 X

FOREIGN PATENT DOCUMENTS

FR 2 671 047 12/1990
WO 0826594 * 3/1998

* cited by examiner

*Primary Examiner*—David Bagnell
*Assistant Examiner*—Sunil Singh
(74) *Attorney, Agent, or Firm*—Larson & Taylor, PLC

(57) ABSTRACT

Hydrostatic balancing jacket including a coupling between at least one of the jacket walls and one ballast. The coupling includes complementary coupling elements reciprocally movable on the jacket wall and on the ballast, and a locking structure for the coupling.

9 Claims, 3 Drawing Sheets

HYDROSTATIC BALANCING JACKET WITH REMOVABLE BALLAST

BACKGROUND AND SUMMARY OF THE INVENTION

The present invention refers to hydrostatic balancing jackets, and in particular to a hydrostatic balancing jacket provided with removable ballast.

For a long time hydrostatic balancing jackets have been part of the normal equipment of a diver.

Normally, the balancing jackets include a dorsal element from which project two abdominal pectoral parts and two strap pieces, connectable with each other. Generally, the pectoral abdominal parts or the dorsal element are inflatable and allow the floating of the diver, who can adjust the inflation pressure to change his depth level.

This equipment has developed both from the point of view of the wearability and the functionality. Its development has somewhat required the adjustment of other equipment; in fact it proves to be rather uncomfortable to wear, together with the jacket of the type now on the market, the lead weight belt which for a long time has been the diver's ballast. The easiest solution is to place the ballast on the jacket so that it can be removed.

In U.S. Pat. No. 5,641,247 there is described a balancing jacket provided with at least one pocket proper to contain a weight; the weight in turn preferably contained within a bag having a shape and size proper for its insertion into said pocket.

This solution provides for an easy ballast system adjustable according to the jacket and not having the usual ballast supporting means, such as belts or the like. Nevertheless, there is a strong dependence on the size and shape of the pocket designed to house the weight and the bag containing it.

In U.S. Pat. No. 5,803,667 there is described a jacket provided with at least one pipe, and at least one container provided with stiffening means able to support at least one weight for the insertion and the removal of said container in said pipe. In this case also, even if the insertion of the ballast is guided, and thus more controlled, the reciprocal sizes of the pipe and the container proper to contain the weight have remarkable importance.

The aim of the present invention is then a balancing jacket to which could be connected a ballast independently of the shape or the size of the jacket.

An object of the present invention is then to provide a hydrostatic balancing jacket including coupling means between at least one of the jacket walls and one ballast wherein said coupling means include complementary means reciprocally removable respectively placed on the jacket wall and on the ballast, being provided with locking means for said coupling.

An embodiment of the coupling means includes a guide connected to the jacket wall, co-operating with a cursor projecting from the ballast. The ballast can include a container able to house one or more weights, or can be formed by the weights themselves, made in the most proper way for this purpose.

BRIEF DESCRIPTION OF THE DRAWINGS

Further advantages and features of the balancing jacket according to the present invention will be clear by reference to the following detailed description of an embodiment of the same, shown as a non-limitative description, with reference to the figures of the enclosed drawings, where.

DESCRIPTION OF THE PREFERRED EMBODIMENT OF THE INVENTION

Figure 1:
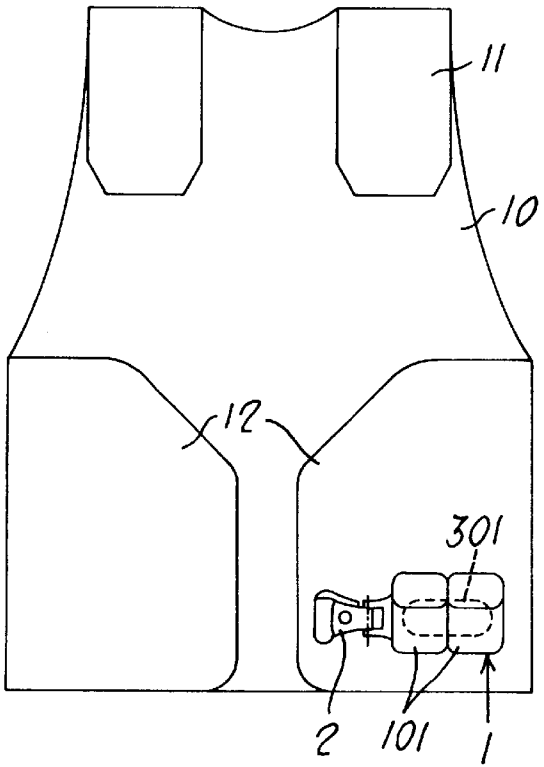
FIG. 1 is a front elevation schematic view of a balancing jacket according to the present invention.

In FIG. 1 is schematically shown the balancing jacket according to the present invention; said jacket includes a dorsal element 10, from which project two strap pieces 11 and two pectoral abdominal parts 12. On one of said pectoral abdominal parts is placed the ballast 1; it includes the containers 101 coupling with the plate 301 (dotted line in figure) placed on the part 12. The ballast is moreover provided with locking means 2.

Figure 2:
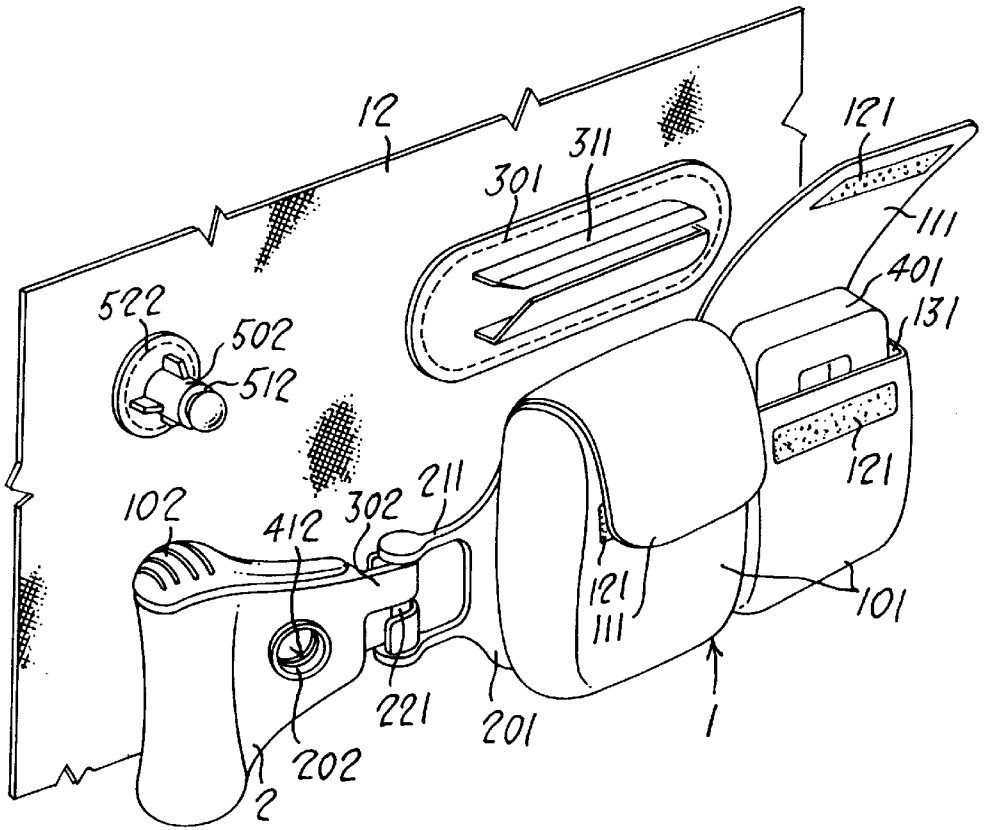
FIG. 2 is a detail in perspective showing the coupling and locking means of the jacket ballast.

FIG. 2 is an enlarged detail of the invention jacket, with the ballast 1 separated from the jacket itself. The ballast 1 includes the containers 101, provided with the openings 131 where one weight 401 is inserted; on the container 101 wall and on the foldable layer 111 of the same container are placed Velcro strips 121 allowing the closing of the container. On the back the containers 101 are fastened to the support 201 provided at one end with the bracket 211 on which is assembled the pin 221. The locking means of the ballast include a body 2 provided with a through hole 202; within the lock is inserted the plate 402, integral with the push-button 102, within which is the hole 412, misaligned with the hole 202. The body 2 is connected to the pin 221 through the J arms 302. The pin 502 projecting from the part 12 and connected with it through its base 522 is designed to co-operate with the holes 202 and 412 through the groove 512 radially formed on the side surface. To the side of the pin 502 on the jacket part 12 is fastened the plate 301 on which the guide 311 is formed.

Figure 3:
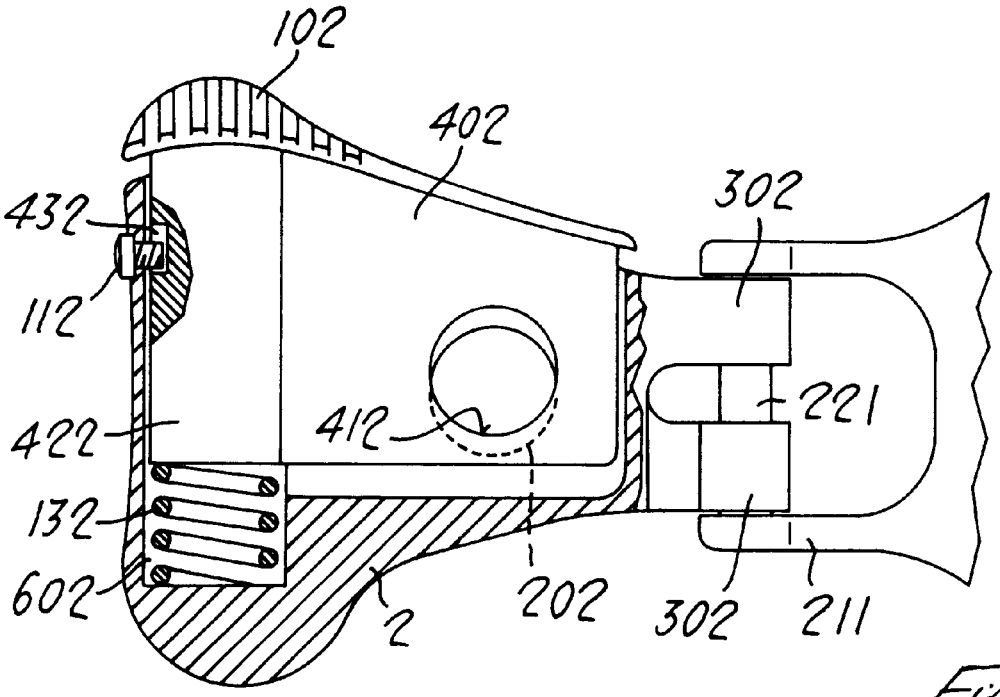
FIG. 3 is an elevation view with sectioned parts of a detail concerned with the locking means.

FIG. 3 shows in detail the operation of the ballast locking means. The plate 402, whose outer side edge is connected to the push-button 102, is provided with a through hole 412 whose dimensions are the same of the hole 202 formed on the body 2. The cylindrical part 422 connected to said plate 402, sliding within the cylindrical cavity 602 formed in the body 2, is normally pushed upwards by the spring 132, so that the hole 202 and the hole 412 are misaligned with each other. The co-operation between the radial pin 112 and the radial cavity 432 of the cylindrical part 422 prevent the plate 402 from going out of its housing within the body 2.

Figure 4:
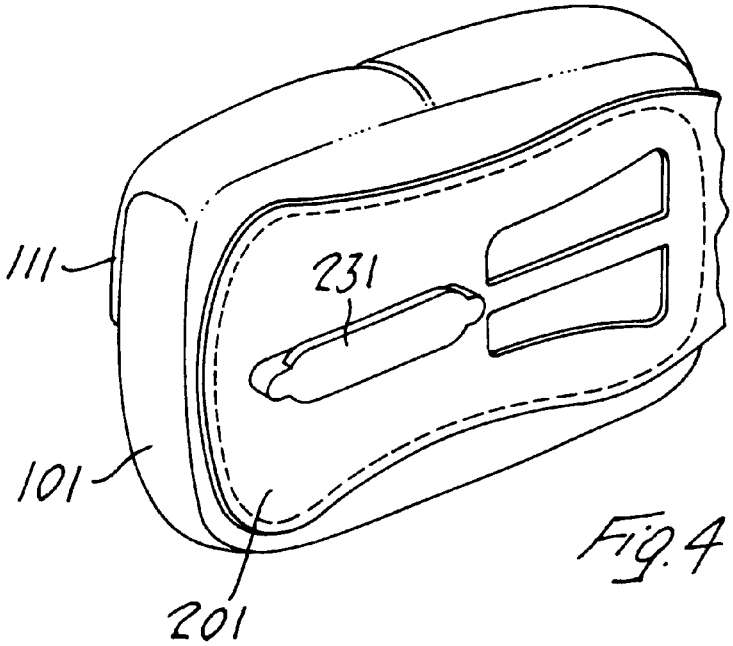
FIG. 4 is a perspective view of a detail concerned with the ballast coupling means.

FIG. 4 shows the ballast in rear view; the support 201 can be seen more easily on which is formed the cursor 231 designed to co-operate with the guide 311 of the plate 301 shown in FIG. 2.

Figure 5:
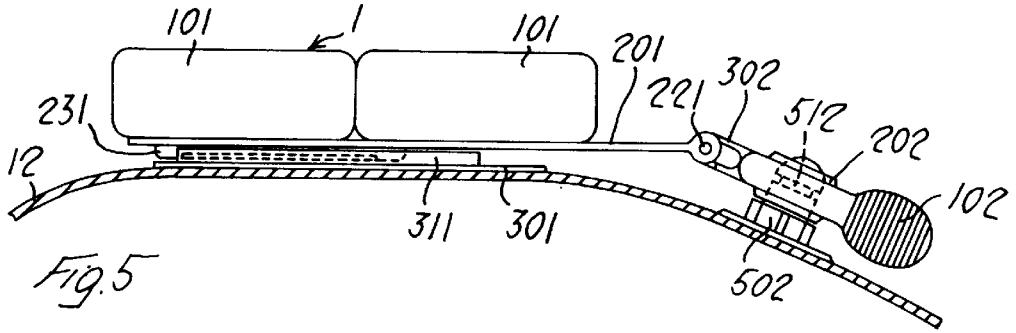
FIGS. 5 to 7 show the operation of the balancing jacket according to the present invention.
Figure 6:
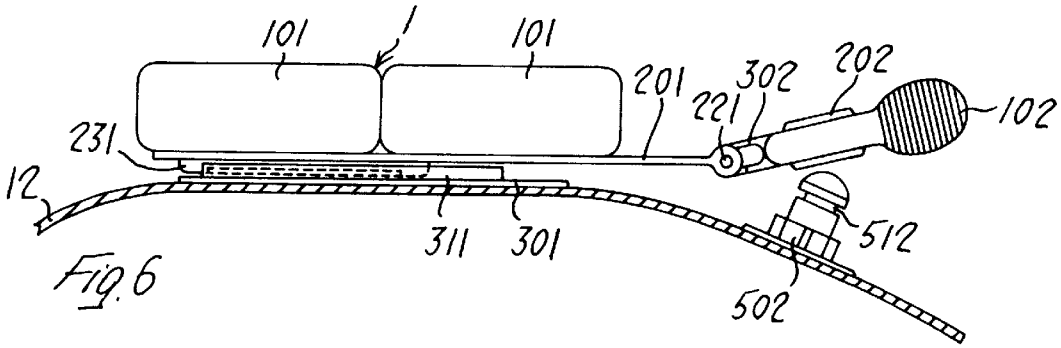
Figure 7:
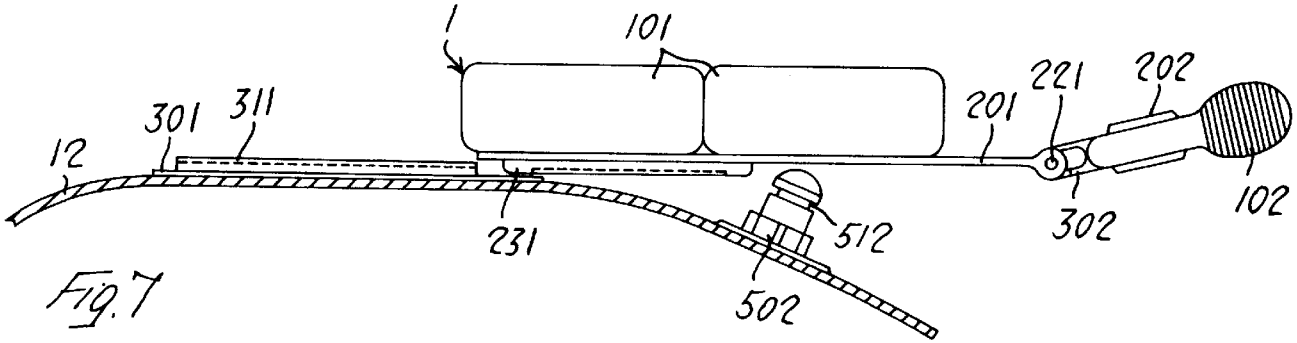

The functioning of the balancing jacket according to the present invention will become clear from the following, with reference to FIGS. 5 to 7 of the enclosed drawings. In FIG. 5 the ballast 1 appears connected with the wall of the balancing jacket pectoral abdominal part 12, with the cursor 231 on support 201 of the containers 101 inserted in the guide 311 formed on the plate 301 connected to said part 12. Moreover the pin 502 is caged in the hole 202 of the body 2. As is evident from FIG. 3 previously described, the misalignment between the hole 412 of the plate 402 and the hole 202 locks the pin 502 operating on its groove 512. In this situation the ballast 1 is connected to the jacket, and it is not possible for it to get released, even accidentally.

To separate the ballast from the jacket, the diver has to realign the two holes 412 and 202, to allow the pin 502 to go out from these holes; then by grasping the body 2 and rotating it to the outside about the pin 221, to remove the pin 502 from the body 2. At this point, the last operation is to release the cursor 231 from the guide 311, which occurs by simply pulling the ballast 1 past the locking pin 502. These easy operations performed in inverse order allow one to connect the jacket to the ballast. It is obvious that the ballast can be positioned in any outer or inner wall of the jacket, and also to the ventral band of the jacket, not shown in the enclosed drawings.

The balancing jacket so designed is effectively provided with easily positionable and easily releasable ballast and whose weight can be changed in the most simply way.

What is claimed is:

1. A hydrostatic balancing jacket comprising, a ballast having a first coupling element, a second coupling element on a wall of the jacket, the first and second coupling elements being movable reciprocally generally along the jacket wall into and out of coupling engagement with each other to respectively couple the ballast to the wall of the jacket and release the ballast from the wall of the jacket, and a releasable locking device for releasably locking the ballast onto the jacket wall when the first and second coupling elements are in coupling engagement with each other.

2. A hydrostatic balancing jacket according to claim 1, wherein one of the coupling elements is formed as an elongated guide and the other is formed as a cursor reciprocally movable into and out of the guide.

3. A hydrostatic balancing jacket according to claim 2, wherein the cursor is formed on the ballast and the guide is formed on the jacket wall.

4. A hydrostatic balancing jacket according to claim 1, wherein the ballast includes a support, the coupling element of the ballast being mounted on the side of the support facing the jacket wall, and containers formed on the other side of the support for receiving weights.

5. A hydrostatic balancing jacket according to claim 1, wherein the locking device includes a body hinged to the ballast and releasably connectable to the jacket wall, wherein when connected to the jacket wall, it prevents reciprocal movement of the two coupling elements.

6. A hydrostatic balancing jacket according to claim 5, said body including a wall having a hole and including a pin formed in the jacket wall, and wherein the locking device locks by insertion of the pin into the hole.

7. A hydrostatic balancing jacket according to claim 6, including a plate movably mounted in the body, said plate having a hole of the same size as the hole in the body wall but normally spring biased out of alignment therewith, such misalignment acting to engage a radial groove in the pin of the jacket wall to lock the body to said pin.

8. A hydrostatic balancing jacket according to claim 7, said plate being spring biased to the normal misalignment position of the two holes, and including a button for urging the plate against the spring bias to align the holes for removal of the body and plate from the pin.

9. A hydrostatic balancing jacket according to claim 1, wherein the coupling elements permit the ballast to move reciprocally along the surface of the jacket wall, essentially parallel thereto, into and out of coupling engagement with each other, and the locking device includes a body connected to the ballast and releasably connectable to the jacket wall, whereby connecting the body to the jacket wall locks the first and second coupling elements together, and removing the body from the jacket wall allows reciprocal movement of the ballast and jacket wall out of engagement with each other.

* * * * *